United States Patent [19]

Walda et al.

[11] Patent Number: 4,780,033

[45] Date of Patent: Oct. 25, 1988

[54] RAIL CAR WITH ROTATABLE FLOOR FOR QUICK LOADING AND UNLOADING OF TRAILERS

[76] Inventors: Fedde Walda, Leendert Sparreboomstraat 15; Nanne M. Walda, Leendert Sparreboomstr. 13, both of 3078 JJ Rotterdam; Benne F. Walda, De Koumen 22, 6433 KD Hoensbroek, all of Netherlands

[21] Appl. No.: 110,095

[22] Filed: Oct. 15, 1987

Related U.S. Application Data

[63] Continuation of Ser. No. 882,077, Jul. 7, 1986, abandoned.

[30] Foreign Application Priority Data

Jul. 4, 1985 [NL] Netherlands ..... 8501912

[51] Int. Cl.[4] ..... B61D 3/18; B61D 47/00

[52] U.S. Cl. ..... 410/1; 105/455; 414/387; 414/401; 104/45

[58] Field of Search ..... 104/27, 29, 30, 35, 104/45; 105/238.1, 355, 455; 410/1, 3, 56; 414/387, 401, 584

[56] References Cited

U.S. PATENT DOCUMENTS 28,969 7/1860 Cooley ..... 414/387 X
1,545,890 7/1925 Fowler ..... 410/1
3,916,799 11/1975 Smith ..... 410/1
4,425,064 1/1984 Walda et al. ..... 105/455 X

FOREIGN PATENT DOCUMENTS 0114895 9/1901 Fed. Rep. of Germany ..... 104/30

*Primary Examiner*—Robert B. Reeves
*Assistant Examiner*—Scott H. Werny
*Attorney, Agent, or Firm*—Frishauf, Holtz, Goodman & Woodward

[57] ABSTRACT

A railroad freight car having a rotatable loading floor for transferring loads between it and a station platform. The railroad station has two platforms on opposite sides of the rail car. An edge of each platform is provided at each longitudinal end with a sloping beam which angles upwardly from the end of the platform towards its center. The lowest part of the beam, which is at the free end of the platform, is below a set of wheels carried on the chassis of the rail car. The center portion of the platform is at a height above that of these rollers. The rollers are arranged to extend laterally of the rail car and to overlie the beams. As the rail car pulls into the station, the rollers will engage the upwardly sloping part of the beams to thereby raise the chassis in relation to its wheels by virtue of extending the suspension as the car continues in its direction of movement. The chassis is, thus, brought into a suitable level to enable the loading floor to freely rotate to overlie the station platform and, thereby, enable the loading and/or unloading operations to take place.

15 Claims, 3 Drawing Sheets

RAIL CAR WITH ROTATABLE FLOOR FOR QUICK LOADING AND UNLOADING OF TRAILERS

This application is a continuation of application Ser. No. 882,077, filed July 7, 1986, now abandoned.

BACKGROUND OF THE INVENTION

The present invention relates to the transport of freight by railroad and, more particularly, to a rail car with a rotatable loading floor pivotally mounted to it for the quick loading and unloading of vehicles which can be rolled onto and off of the loading floor from a station platform located adjacent the side of the rail car.

Various approaches have been utilized to facilitate the transfer of loads, such as vehicles, between rail cars and station platforms. As disclosed in U.S. Pat. No. 4,425,064 a rotatable loading floor is pivotally mounted onto the chassis of a rail car. However, because at least a portion of the loading floor is positioned below the height level of the station platform when the rail car chassis is at its normal height, a lifting system must be used to raise the chassis to a height at which the loading floor clears the station platform so that it can freely rotate to its operative position. The lifting system adds to the cost and complexity of the rail car. Furthermore, the loading and unloading operations at the station are slowed down by the need to raise and lower the chassis.

SUMMARY OF THE INVENTION

It is a general object of the present invention to provide an improved freight transport technique involving a rail car with a rotatable loading floor for transferring loads between a station platform and the rail car.

A more specific object of the present invention is to provide a load transfer technique involving a rail car to which is pivotally mounted a rotating loading floor that does not require a lifting operation to raise the height of the chassis so that the loading floor clears the station platform in order to permit the loading floor to be rotated into its operative position.

Another object of the present invention is to provide a load transfer technique involving a rail car with a rotating floor which automatically properly positions the loading floor in relation to the station platform as the rail car rolls into the station.

These and other objects of the present invention are attained by a system for transferring loads between a rail car and a pair of station platforms of substantially equal height and located on respective opposite longitudinal sides of the rail car for transferring loads between the rail car and a station platform, the rail car includes a chassis supported by wheels to which it is coupled by a suspension, the chassis also including a deck. An elongated loading floor is pivotally mounted on the deck and is rotatable relative to the chassis in a substantially horizontal plane between first and second positions. The first position is a position in which the longitudinal axis of the loading floor coincides with the longitudinal axis of the rail car. The second position is a position in which at least one end of the loading floor overlies a station platform at the side of the rail car in operative association with the station platform for transferring a load between the loading floor and the station platform. Means are also provided for rotating the loading floor between the first and second positions. The improvement of the invention over prior approaches includes a first set of rollers coupled to and on each longitudinal side of the chassis, such rollers being positioned laterally to overlie an edge of the pair of station platforms adjacent to the rail car. Such rollers are positioned vertically when the chassis is at its preset height so as to be adapted to engage the adjacent longitudinal edge of the pair of the station platforms as the edge slopes in the longitudinal direction of the station platform between a height lower than the preset height and a height higher than the preset height. The platform has its ends at a height below the preset height and its center portion is at a height higher than the preset height. The loading floor is higher than the pair of station platforms when the rail car is at the center portion of the station platforms. The chassis is raised from its preset height by extension of the suspension by the time the rail car reaches the center portion of the station platform due to the cooperation between the rollers and the sloped edge of the station platforms.

DETAILED DESCRIPTION OF THE PREFERRED EMBODIMENTS

Figure 1:
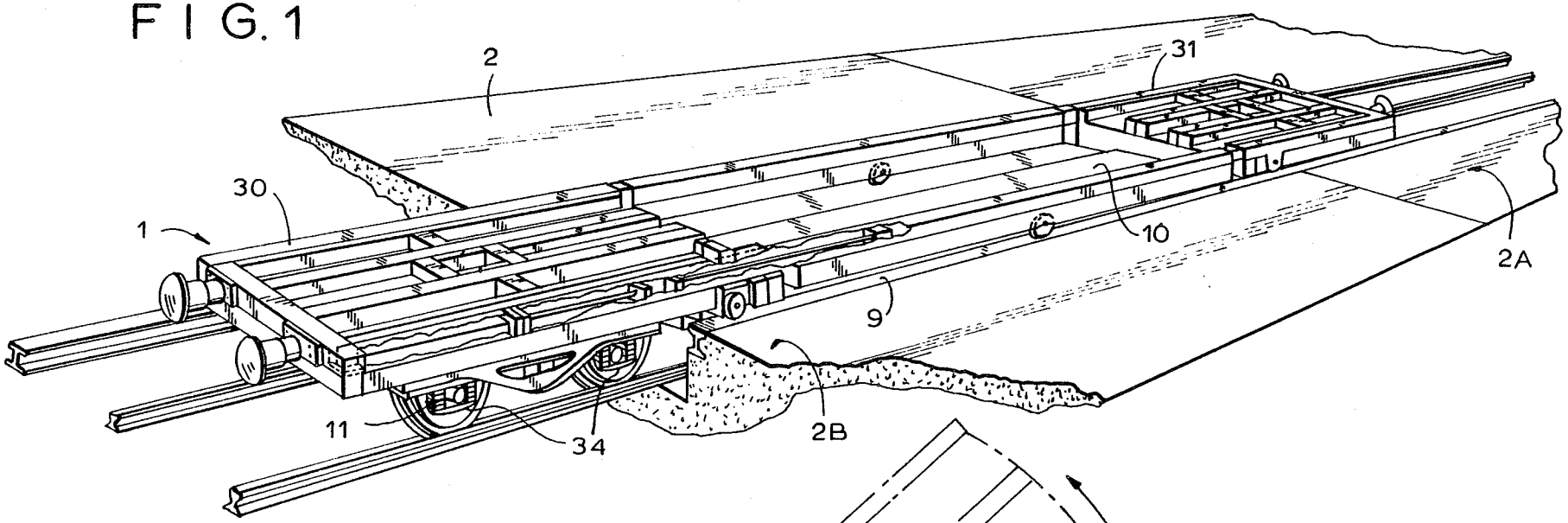
FIG. 1 is a perspective view of a rail car and a pair of station platforms alongside it.
Figure 6:
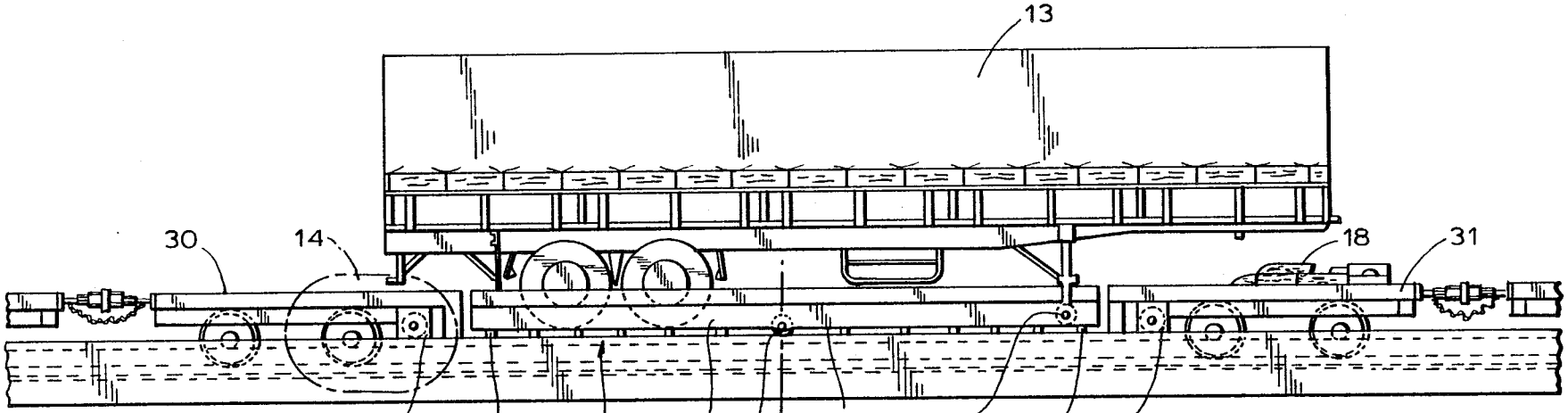
FIG. 6 is a side view of the rail car as it stands next to a station platform while loaded with a trailer.

As best shown in FIGS. 1 and 6, rail car 1 includes a chassis with wheel support trucks 30 and 31 at its two ends Wheels 34 are coupled to the wheel support trucks via suspension 11. Suspension 11 is of a conventional type and includes springs 40 (see FIGS. 4 and 5). The chassis also includes deck 17 located between and coupled to or integral with the wheel truck supports 30 and 31. Deck 17 is an elongated section which makes up much of the length of rail car 1 and above which the loads to be transported are carried.

Figure 2:
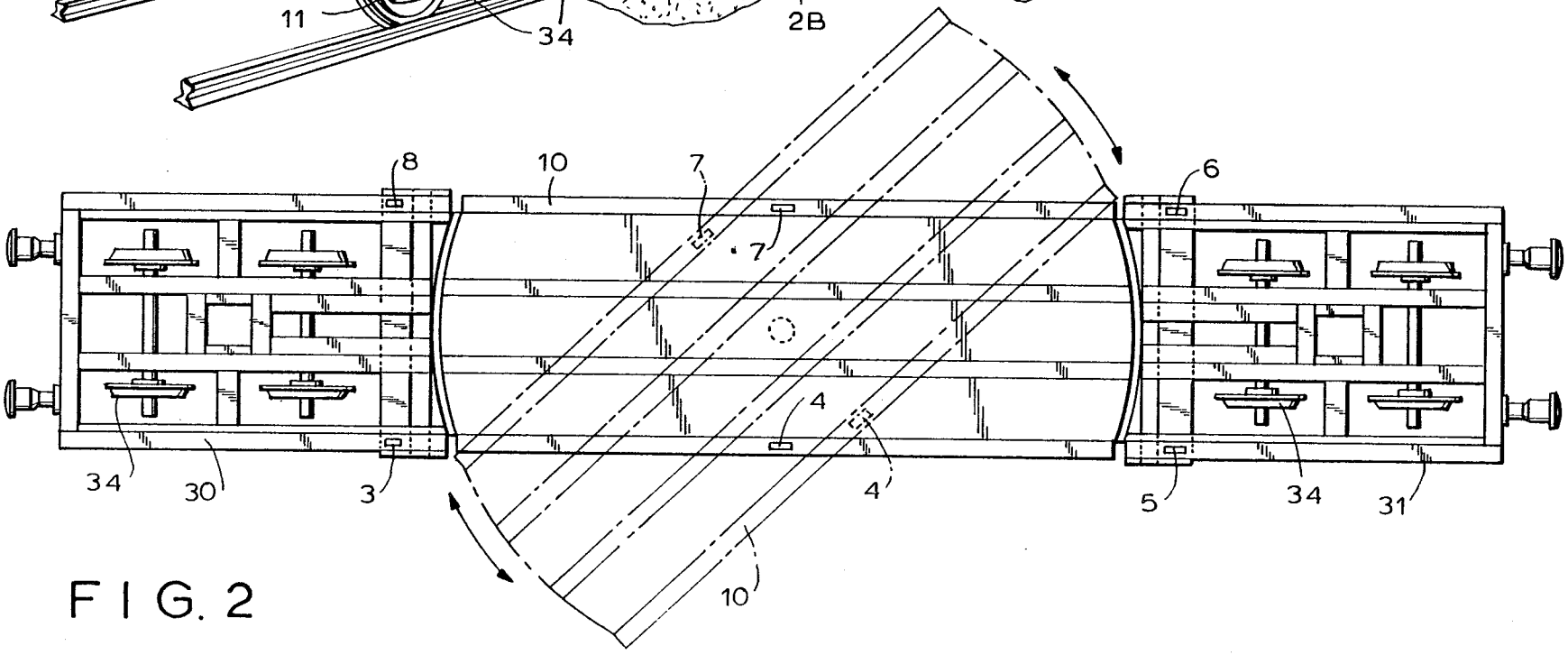
FIG. 2 is a top plan view of the rail car with the rotatable loading floor being shown in its stored position in solid lines and in its rotated operative position overlying the station platform in broken lines.

A rotatable loading floor 10 is pivotally coupled to deck 17 by axle 42 (FIG. 2). Rollers 15 are provided between loading floor 10 and deck 17 to facilitate the rotational movement of loading floor 10, as described below. Rollers 15 are distributed in an equally spaced arrangement and coupled to each side of loading floor 10. Sixty such rollers are provided on each side. A mechanism including axle 42 is provided to pivotally couple loading floor 10 to deck 17. Also, a further mechanism is provided to effectuate rotation of the loading floor about its pivot point. This includes suitable gearing, electrical and/or hydraulic motors, and an electrical and/or hydraulic control system. During motion of the rail car, loading floor 10 must be secured to the chassis to prevent it from being inadvertently rotated by the rocking motion of the rail car, for example.

Conventional securing means can be used. The gearing, motors, control system, loading floor, axle pivot, and securing means are disclosed in the above-mentioned U.S. Pat. No. 4,425,064 which is hereby incorporated by reference.

Because of the way rail cars for hauling freight are normally constructed, a rotational loading floor pivotally mounted thereon has at least a portion thereof positioned below the upper surface of the station platform. The station platform interferes with its rotation and the loading floor, therefore, cannot rotate into its operating position for loading and unloading. In order to place the loading platform into a position where it completely clears the station platform so that its freedom of rotational motion is not so restricted, the chassis must be raised to a suitable height. In accordance with a particularly advantageous feature of the present invention, the chassis cooperates with a specially configured station platform to automatically raise the chassis to an appropriate height as the train pulls into the railroad station. Details of how this is done are provided below.

As best shown in FIG. 2, rail car 1 is provided with a set of six rollers with rollers 3, 4 and 5 being on one side and rollers 6, 7, and 8 being on another side. Rollers 3 and 8 are coupled to wheel support truck 30 while rollers 5 and 6 are coupled to wheel support truck 31. Likewise, rollers 4 and 7 are coupled to loading floor 10 on either side of axle 42. All of these rollers are mounted at the same height. Moreover, the bottom of these rollers is at the same height as the bottom of smaller rollers 15 which are coupled to loading platform 10.

Station platform 2 is provided in accordance with the present invention with a beam 9 located in its upper corner adjacent rail car 1. Both of the pair of station platforms on either side of rail car 1 are outfitted with beam 9. Since the two platforms are identical, and because only one of them is clearly visible in the drawings, the following discussion will involve only one, but it clearly applies to the pair. Beam 9 is an I.P.E. beam which is sloped so that at center portion 2A of platform 2 it is higher than at end portion 2B of platform 2. Preferably, the slope of beam 9 is such that it extends from a height which is 12 cm. lower than that of center portion 2A of station platform 2, and it is angled to rise approximately 2 cm. over 10 meters. The total slope length is 60 meters. Thus, beam 9 rises a total of 12 cms. from its beginning at the extreme end 2B of station platform 2 until it reaches the center portion 2A of station platform 2. Center portion 2A is level throughout its length.

Although the other end of station platform 2 has not been shown, it should be understood that the other end also includes a beam 9 sloped in the same fashion as beam 9 on end portion 2B, but in the opposite direction. In other words, beam 9 of end portion 2B can be said to slope upwardly toward center portion 2A, while a beam 9 in the other end portion can be said to slope downwardly from center portion 2A to the extreme other end of station platform 2. The various dimensions of the two ends of the station platform are substantially identical.

As best shown in FIG. 1, rollers 3–8 are laterally located on rail car 1 so as to jut out over station platform 2. Specifically, these rollers overlie beam 9. Also, when the chassis of rail car 1 is at its normal height, the height of the bottom of these rollers is between the height of the end of beam 9 at the extreme end of end portion 2B and that of its end at the center portion 2A of platform 2.

Figure 3:
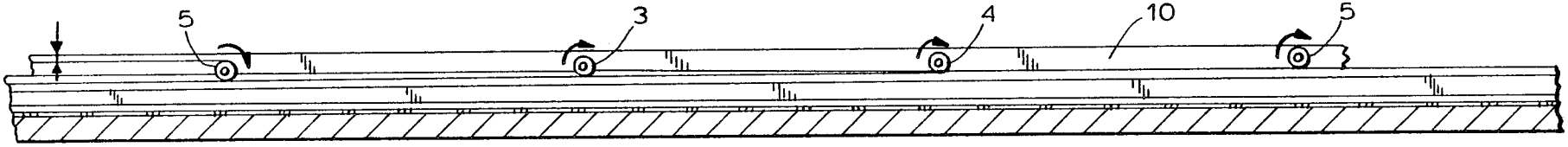
FIG. 3 is a longitudinal cross section of the platform showing the sloped beam at the edge of each station platform on which wheels coupled to the side of the chassis rise to raise it to its appropriate height.
Figure 5:
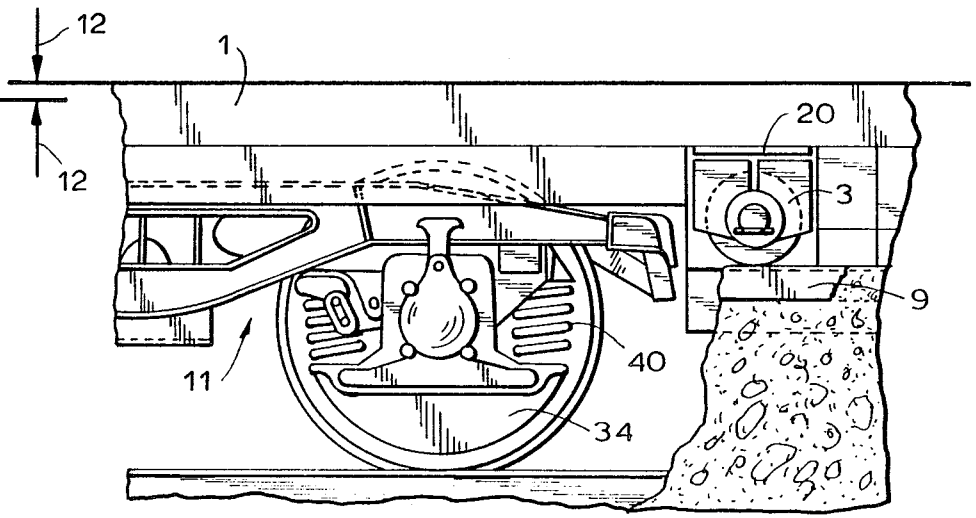
FIG. 5 is the same view of FIG. 4, but showing the chassis raised from its normal height and the extended spring suspension.
Figure 4:
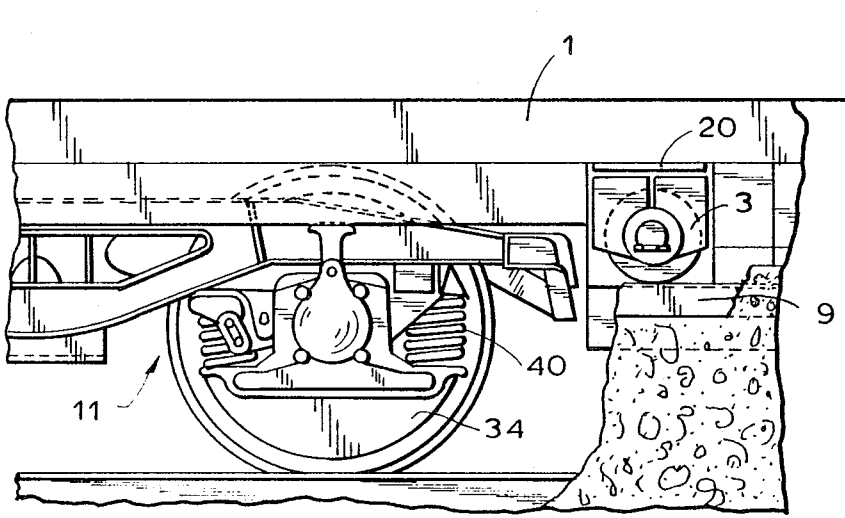
FIG. 4 is a fragmentary side view of a portion of the chassis coupled to the wheels by a suspension when the chassis is in its normal height.

As a result of this relative arrangement of lateral positioning and height between rollers 3–8 and beams 9, as rail car 1 pulls into the station the roller which is in the forward-most position dependent on the direction of motion will contact the upwardly sloping beam 9. Engagement between this forward-most roller and beam 9 will result in lifting the front of the chassis relative to wheels 34 by virtue of the extension of suspension 11. This is best shown in the comparison between FIGS. 4 and 5. FIG. 4 shows rail car 1 in its normal height as roller 3 engages a lower section of beam 9. FIG. 5 shows spring 40 of suspension 11 extended as rail car 1 is raised due to the engagement between beam 9 and a higher section of roller 3. As movement of the rail car continues, the next roller will also engage beam 9 and act to further raise the height of the chassis. This is best shown in FIG. 3 which depicts roller 5 as the lead roller. Roller 5 has already progressed far along beam 9 while roller 4 is part of the way up the slope. Roller 3 has just engaged beam 9 and risen only slightly up its slope. Finally, roller 5 of the next succeeding rail car appears to have just engaged the bottom-most portion of beam 9 and is about to be pulled up its slope.

In the preferred embodiment, the total length of the platform is contemplated to be 700 meters. As stated above, the sloped portion of beams 9 runs for 60 meters at each end of station platform 2. The total vertical rise of beam 9 is approximately 12 cms. At its low end, it is approximately 6 cm. below the height of the bottom of rollers 3–8 at the normal height of the chassis of rail car 1. The 6 cm. difference allows for accommodating heavily loaded rail cars which dip down below the normal height but will still be above the exposed end of beam 9 at end portion 2B of platform 2. When rail car 1 is at center portion 2A of station platform 2, deck 17 must be level with the platform so that rollers 15 can smoothly glide from deck 17 onto the station platform. In order to compensate for any misalignments in rail car 1, shims 20 (see FIGS. 4 and 5) can be placed between the chassis and the support which couples wheels 3–8 to the chassis. Rollers 15 have a diameter of 80 mm., and are coupled by suitable conventional means (not shown) to loading floor 10. Rollers 3, 5, 6 and 8 each have a load capacity of 25 tons at a speed of 15 km/hr. Rollers 4 and 7 each has a load capacity of 20 tons. The 120 rollers 15 can together handle a maximum load gross capacity of 55 tons on rotatable floor 10.

Wheel support truck 31 has secured to it a trailer saddle coupling 18 which is shown in its collapsed state and can be extended upward. In its extended position, coupling 18 is forcefully wedged between the trailer and the chassis so as to lock it in position to prevent rolling or sliding during acceleration and deceleration of rail car 1. In addition, coupling 18 relieves the loading floor 10 from some of the burden of the trailer and more evenly distributes the load over the entire rail car. Further details on coupling 18 are disclosed in U.S. Pat. No. 4,425,064.

In operation, as rail car 1 approaches station platform 2, the leading edge of beams 9 on the pair of station platforms is at a height below that of rollers 3–8. As the rail car moves into the station, and assuming that rollers 5 and 6 are at the front of rail car 1 in its direction of movement, rollers 5 and 6 will first pass over beams 9 without touching them until the upward slope of beams 9 reaches the height of the bottom of these rollers. At that point, rollers 5 and 6 will engage beams 9 and roll on them as rail car 1 continues to move in the same direction. Rollers 5 and 6 will lift rail car 1 from its wheels by way of the extension of suspension 11. Thereafter, as rollers 4 and 7 engage beams 9, the lifting action is continued and is then followed with the engagement of rollers 3 and 8 by beams 9. When all of rollers 3–8 are at center portion 2A of station platform 2, the rail car will have typically undergone a rise in its height of approximately 6 cms. As soon as the train stops, rail car 1 is ready to be unloaded, or loaded, with no need to spend time and effort on raising the chassis to an appropriate height in order to position loading platform 10 so that it is cleared to be rotated into its operating position. With the advantageous contribution of the present invention, the needed lifting operation has already been done automatically by virtue of the cooperation between wheels 3–8 and beams 9 of the pair of station platforms 2. Accordingly, the rotating mechanism (not shown) can be immediately actuated (after the securing means is released, of course) to rotate loading floor 10 into its operating position which is approximately 45° from its carrying position when stored on the chassis.

In the raised position of the chassis when rail car 1 is at center portion 2A of station platform 2, the height of deck 17 of rail car 1 is even with the platform. Therefore, loading floor 10 can readily be rotated to its operating position on rollers 4, 7, and 15.

When the desired load transfer operations at the station are completed, the rotating mechanism is again actuated to return loading floor 10 to its position on rail car 1 with its longitudinal axis aligned with the longitudinal axis of the rail car. Once this alignment has been obtained, the securing means (not shown) is locked to secure loading floor 10 in position to prevent its unwanted movement during motion of the rail car. After this operation has been completed for all rail cars 1 making up the freight train, the train can move out of the station. As this movement proceeds, rail car 1 will descend from center portion 2A on beams 9 at the other end of the pair of station platforms 2. Rollers 5 and 6 will follow the downward slope of beams 9 until the normal height of rail car 1 is regained. At this position, wheels 5 and 6 will no longer engage beams 9. This then also happens, in turn, to rollers 4 and 7, and then to rollers 3 and 8. Normal rolling motion of rail car 1 is then resumed until the next station is reached.

Although a preferred embodiment of the present invention has been disclosed above, it is apparent that various modifications to it can readily be made. For example, the securing means can also be that disclosed in commonly assigned copending application Ser. No. 06/882,544, filed on July 7, 1986, titled Locking and Stiffening Means for a Rail Car with a Rotatable Loading Floor. This and other such modifications are intended to fall within the scope of the present invention as defined by the following claims.

I claim:

1. In a rail car for use with a pair of station platforms of substantially equal height relative to each other and located on respective opposite longitudinal sides of said rail car for transferring loads between the rail car and at least one of said station platforms, said rail car having a chassis supported by wheels to which it is coupled by a suspension, said chassis including a deck; an elongated loading floor pivotally mounted on said deck and being rotatable relative to said chassis in a substantially horizontal plane between first and second positions, said first position being a position in which the longitudinal axis of the loading floor coincides with the longitudinal axis of the rail car, and said second position being a position in which at least one end of said loading floor overlies one of said station platforms at the side of the rail car in operative association with the station platform for transferring a load between the loading floor and the at least one station platform; the improvement comprising:

a first set of rollers coupled to and on each longitudinal side of said chassis, said rollers being positioned laterally to overlie an edge of said pair of station platforms adjacent to the rail car, said rollers being positioned vertically when the chassis is at a preset height so as to be adapted to engage said edge of the pair of said platforms as said edge slopes in the longitudinal direction of the station platform between a height lower than said preset height and a height higher than said preset height with said platform having its ends at a height below said preset height and its center portion at a height higher than said preset height, said loading floor being higher than the pair of station platforms when the rail car is at the center portion of the station platforms; and wherein said chassis further comprises wheeled support trucks fore and aft of said deck, each of said first set of rollers on a side of said chassis comprising one roller coupled to the aft support truck, one roller coupled to the fore support truck, and one roller coupled to the loading floor;

whereby said chassis is raised from its preset height by extension of the suspension when the rail car reaches the center portion of the station platform.

2. The rail car of claim 1, further including a second set of rollers between the loading floor and the deck of the chassis upon which the loading floor rolls as it is rotated between said first and second position.

3. The rail car of claim 2, wherein said second set of rollers is coupled to the loading floor and rolls over the at least one of said pair of station platforms as the loading floor is moved between its said first position and its said second position.

4. The rail car of claim 3, wherein the top of said deck is level with the pair of station platforms when the rail car is positioned at the center of said station platform.

5. The rail car of claim 2, wherein said second set of rollers comprises spaced rollers extending along the length of said loading floor.

6. The rail car of claim 5, wherein said second set of rollers comprises 120 rollers, 60 on each side of said loading floor.

7. The rail car of claim 1, wherein the top of said deck is level with the pair of station platforms when the rail car is positioned at the center of said station platform.

8. In a system for transferring loads between a rail car and a pair of station platforms of substantially equal height and located on respective opposite longitudinal sides of said rail car for transferring loads between the rail car and at least one of said station platforms, said rail car having a chassis supported by wheels to which it is coupled by a suspension, said chassis including a deck; an elongated loading floor pivotally mounted on said deck and being rotatable relative to said chassis in a substantially horizontal plane between first and second positions, said first position being a position in which the longitudinal axis of the loading floor coincides with the longitudinal axis of the rail car, and said second position being a position in which at least one end of said loading floor overlies one of said station platforms at the side of the rail car in operative association with the station platform for transferring a load between the loading floor and the at least one station platform; the improvement comprising;

each of said pairs of station platforms having a longitudinal extending edge with a longitudinal center portion at a height higher than its end portions and with a continuous slope extending in the longitudinal direction of the station platform between each of said end portions, respectively, and the center portion, a first set of rollers on each side of said chassis, said rollers being positioned laterally to overlie said edge of said pair of station platforms located adjacent to the rail car, said rollers being positioned vertically when the chassis is at a preset height at a height between that of the said end portions and said center portion, said loading floor being coupled to the chassis so that it is higher than said pair of station platforms when the rail car is at said center portion; and wherein said chassis further comprises wheeled support trucks for and aft of said deck, each of said first set of rollers on a side of said chassis comprising one roller coupled to the aft support truck, one roller coupled to the fore support truck, and one roller coupled to the loading floor.

9. The system of claim 8, wherein said edge comprises the upper corner of the station platform adjacent the rail car.

10. The system of claim 8, wherein at least the sloped portion of said edge comprises a rail.

11. The system of claim 10, wherein the sloped end portions extend for approximately 60 meters.

12. The system of claim 11, wherein the station platform extends for approximately 700 meters.

13. The system of claim 12, wherein the center portion of said pair of station platforms is level.

14. The system of claim 8, wherein at least the sloped portion of said edge comprises a rail.

15. The system of claim 8, wherein the center portion of said pair of station platforms is level.

* * * * *